US007764196B2

(12) United States Patent
Spears

(10) Patent No.: US 7,764,196 B2
(45) Date of Patent: Jul. 27, 2010

(54) METHOD AND APPARATUS FOR DOCUMENTING THE CONDITION OF A VEHICLE

(76) Inventor: Kevin Allen Spears, Rugged CCTV, 5327 Cedar Creek Dr., Kemp, TX (US) 75143-5590

( * ) Notice: Subject to any disclaimer, the term of this patent is extended or adjusted under 35 U.S.C. 154(b) by 297 days.

(21) Appl. No.: 11/805,983

(22) Filed: May 25, 2007

(65) Prior Publication Data

US 2008/0291056 A1 Nov. 27, 2008

(51) Int. Cl.
*G08G 1/01* (2006.01)

(52) U.S. Cl. ..... 340/933; 340/937; 340/938; 348/148

(58) Field of Classification Search ..... 348/143, 348/144, 148, 149, 151; 382/104; 206/316.2; 346/107.2; 340/932.2, 937, 933, 938
See application file for complete search history.

(56) References Cited

U.S. PATENT DOCUMENTS

| | | | | |
|---|---|---|---|---|
| 4,739,779 | A * | 4/1988 | Jones et al. | 134/45 |
| 4,981,523 | A * | 1/1991 | Larson et al. | 134/18 |
| 6,709,530 | B1 * | 3/2004 | Dietsch et al. | 134/18 |
| 6,965,324 | B1 * | 11/2005 | Suggs, Sr. | 340/933 |
| 6,992,595 | B2 | 1/2006 | Auer et al. | |
| 7,231,065 | B2 * | 6/2007 | Peach et al. | 382/104 |
| 2004/0066451 | A1 * | 4/2004 | Schroth | 348/144 |
| 2004/0223074 | A1 * | 11/2004 | Takada | 348/360 |
| 2007/0040911 | A1 | 2/2007 | Riley | |
| 2007/0051646 | A1 | 3/2007 | Imoto et al. | |
| 2008/0229531 | A1 * | 9/2008 | Takida | 15/53.2 |

FOREIGN PATENT DOCUMENTS

| | | | |
|---|---|---|---|
| JP | 2001107595 | | 4/2001 |
| JP | 2002211368 | A * | 7/2002 |
| JP | 2005313839 | A * | 11/2005 |
| JP | 2006076460 | | 3/2006 |
| JP | 2006151268 | | 6/2006 |

OTHER PUBLICATIONS

JP2002211368 Machine Translation Document, Feb. 23, 2010, JPO.*
JP 2005313839 Machine Translation Document,Feb. 23, 2010, JPO.*

* cited by examiner

*Primary Examiner*—Daniel Wu
*Assistant Examiner*—Rufus Point
(74) *Attorney, Agent, or Firm*—Benjamin I. Edlavitch

(57) ABSTRACT

A method and apparatus that includes cameras encased in vandalism and weather resistant housings, which attach to the outside or inside of a tunnel. The cameras provide for overhead, side, front, and rear views of a vehicle as the vehicle approaches and enters the tunnel and as the vehicle exits and leaves the tunnel. In order to provide the views, the camera devices are strategically located at the entrance of the tunnel, at the exit of the tunnel, and within the tunnel. The cameras are attached directly to the structure of the tunnel or are attached to a frame that can be installed inside the tunnel or attached to the tunnel.

15 Claims, 9 Drawing Sheets

METHOD AND APPARATUS FOR DOCUMENTING THE CONDITION OF A VEHICLE

BACKGROUND

Tunnel car wash operators need effective tools to guard against baseless claims brought by customers alleging that the car wash facilities damaged their vehicles. In addition to tunnel car wash operators, full service tunnel and garage owners often receive baseless complaints alleging that their facilities damaged a customer's vehicle.

In the case of tunnel car washes, customers often file claims because they will first notice damage to their vehicles, especially surface damage, after a wash. A scratch or a dent to the surface of a vehicle is much more noticeable on a clean vehicle oppose to one that is covered with dirt and debris. The car wash operator becomes an easy scapegoat, because the customers can honestly claim that they initially saw the damage after taking their vehicles to the car wash.

In addition, the environment of a tunnel car wash makes it hard for operators to defend their facilities. The environment of a tunnel car wash makes it difficult to view a vehicle as it proceeds through the wash. For example, the low lighting in tunnels makes it difficult to view a vehicle. Moreover, obstacles such as mist, excess spray, and large washing devises surrounding the vehicle make viewing the vehicle nearly impossible.

Furthermore, the lack of an eyewitness in a tunnel car wash, besides the driver of the vehicle, makes it difficult for operators to defend their facilities. It is unusual for an employee of a tunnel car wash to watch the vehicle during a mechanically driven wash. In the case of manual washes, eyewitnesses are washers and the driver. If a case concerning the cause of damage to a vehicle ever is litigated, the washers, who jurors will likely consider biased, will be the only eyewitnesses favorable to the defendant.

Beyond honest customers that use tunnel operators as a scapegoat, fraudulent customers often take advantage of tunnel operators' vulnerability to lawsuits. A dishonest customer that is aware of surface damage to his or her vehicle can easily bring fraudulent claims against an operator of a tunnel car wash or other service tunnel for the reasons explained above.

In summary, it is easy for a customer to blame a tunnel operator for damage to his or her vehicle. Without direct proof of when the damage occurred, a reasonable person could infer that the damage could have occurred inside the tunnel, especially a car wash tunnel. Reasonable beliefs are not always based on the facts of a case. In most cases the damage to a vehicle is either pre-existing or occurs after service to the vehicle.

For the reasons described above, tunnel operators and especially tunnel car wash operators have a need system for demonstrating that their facilities were not the cause of damage to a vehicle. Without such proof, it is more likely than not, a customer will get a settlement or verdict in his or her favor against the operator of a tunnel.

Tunnel operators—not only car wash operators—have tried for years to place cameras—video or still cameras—in their facilities to provide evidence that they were not responsible for damage to a vehicle. However, traditional methods of installing cameras are not effective enough to provide adequate evidence in several scenarios. For example, cameras in tunnels are often placed too high to have adequate side views of vehicles. In instances where cameras were lowered to provide side views, the cameras become more susceptible to vandalism. In addition, moving a camera to a lower location limited overhead views of vehicles passing through the tunnel.

Another issue that negatively affects the quality of the views is low levels of light often found in a tunnel. Operators could sufficiently light the tunnel using artificial lighting; however, such lighting has economical costs. If operators place cameras outside of the tunnel or close to the entrance or exit of the tunnel, natural light is more available for producing higher quality views and saving costs associated with artificial lighting. Nevertheless, when an operator places cameras outside a tunnel or near the opening of the tunnel, the cameras become susceptible to weather damage. In addition, when an operator places cameras outside his or her tunnel the cameras become susceptible to vandalism.

To limit damage to cameras, especially ones placed at low positions or outside a tunnel, tunnel operators can enclose cameras in weather and vandalism resistant housings. With the ability to place cameras at lower positions and outside a tunnel, tunnel operators can readily obtain front, back, side, and top views of a vehicle before and after the vehicle passes through the tunnel.

In addition to tunnel car wash operators benefiting, operators of other types of service and roadway tunnels could benefit from placing cameras in weather and vandalism resistant housings and strategically placing the cameras inside tunnels and on the exterior of tunnels.

SUMMARY OF THE INVENTION

A method and apparatus for installing camera devices on the outside and/or inside of a tunnel that provides for recording top, front, rear, and side views of a vehicle entering, passing through, and exiting the tunnel. Embodiments of the method and apparatus can include camera devices placed in an entrance of the tunnel and/or an exit of the tunnel.

BRIEF DESCRIPTION OF THE DRAWINGS

Below is a description of example embodiments of a method and apparatus for documenting condition of a vehicle in conjunction with appended drawings, wherein like reference numerals refer to like elements in figures, and wherein:

figure one (labeled "FIG. 1" in the drawings) is a drawing of an embodiment of a method and apparatus for documenting the condition of a vehicle, where camera devices 22 & 23 are facing opposing sides of a tunnel 20 recording side views of a vehicle 24, and a camera device 21 is facing down recording overhead views of the vehicle 24, as the vehicle 24 approaches and enters the tunnel 20;

Figure 1:
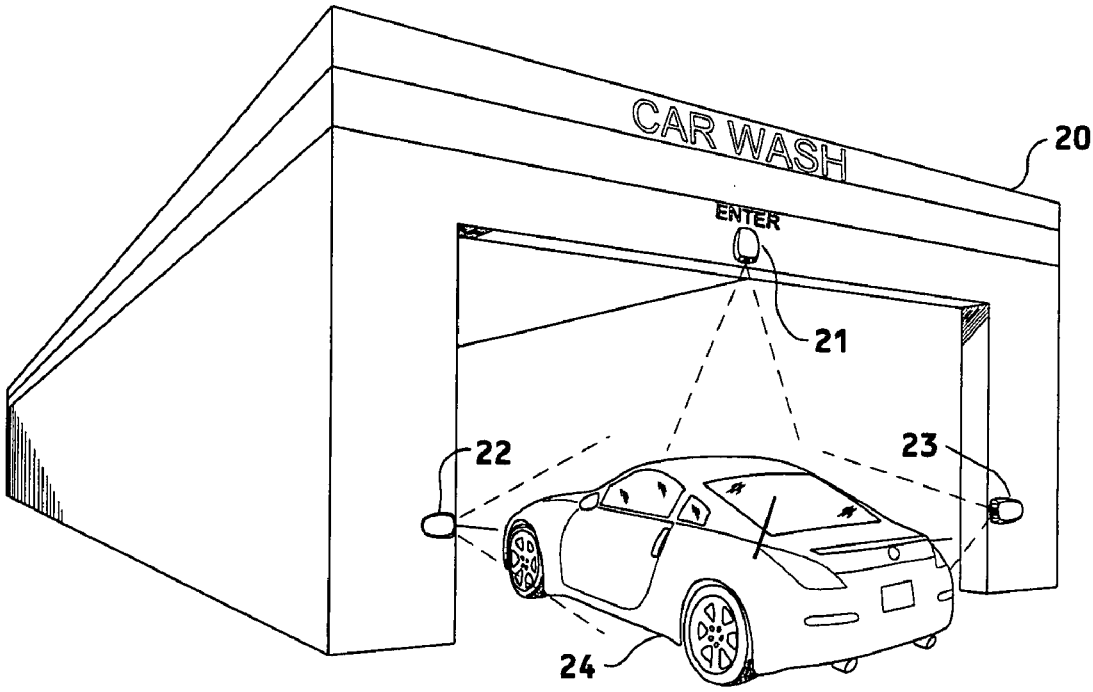
Figure 2:
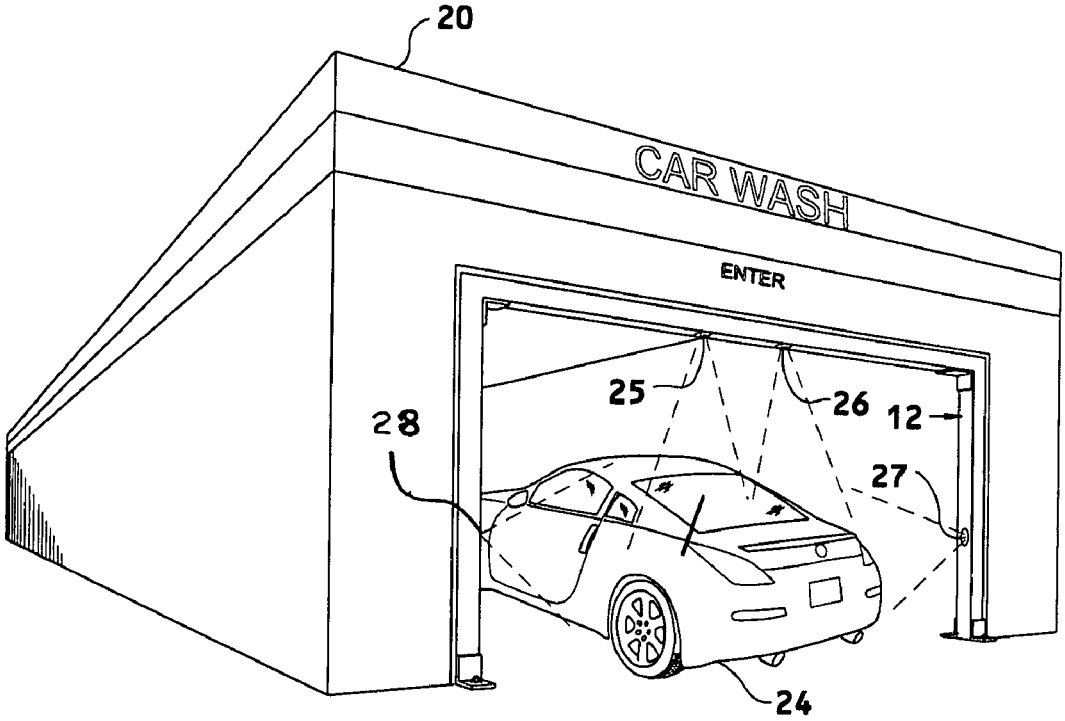
Figure 3:
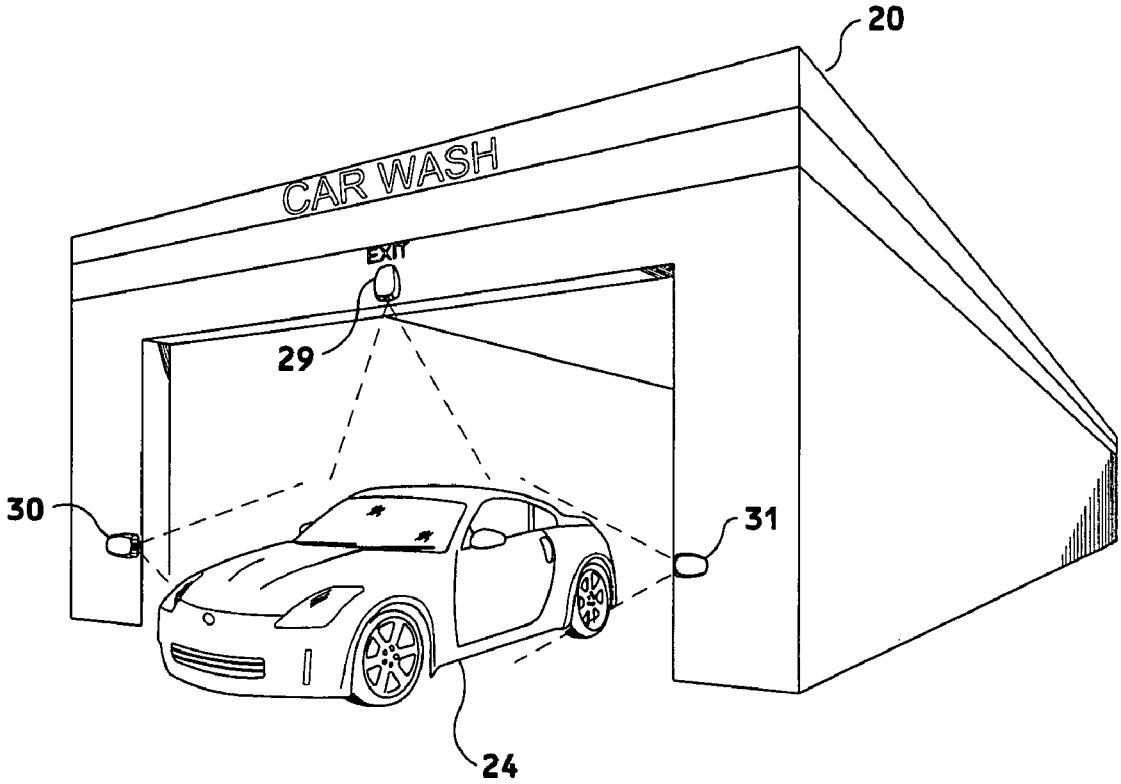
Figure 4:
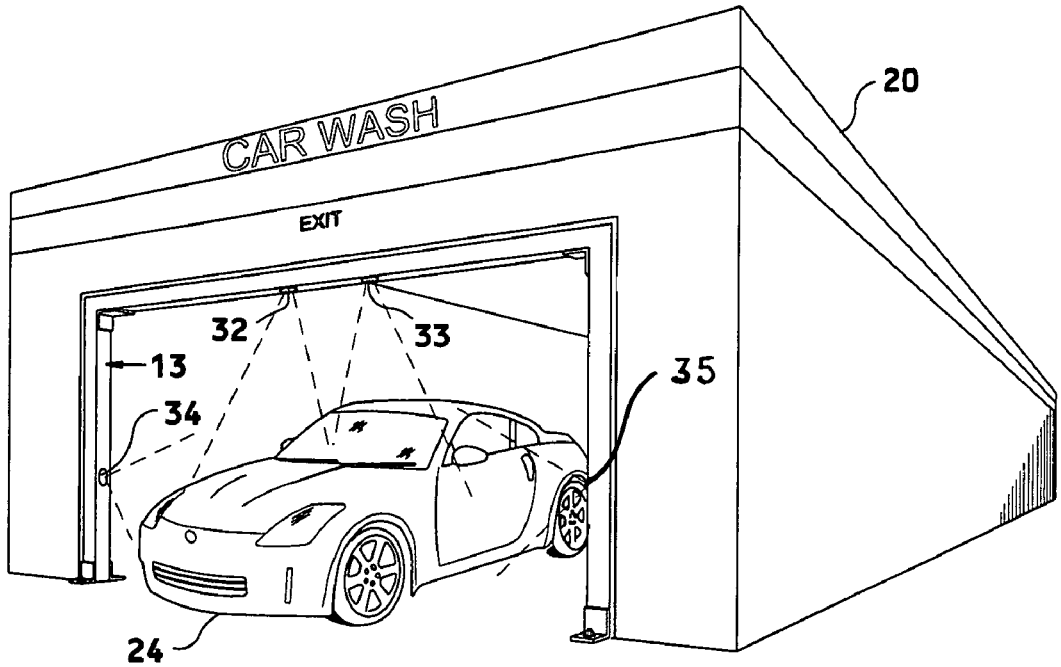
Figure 5:
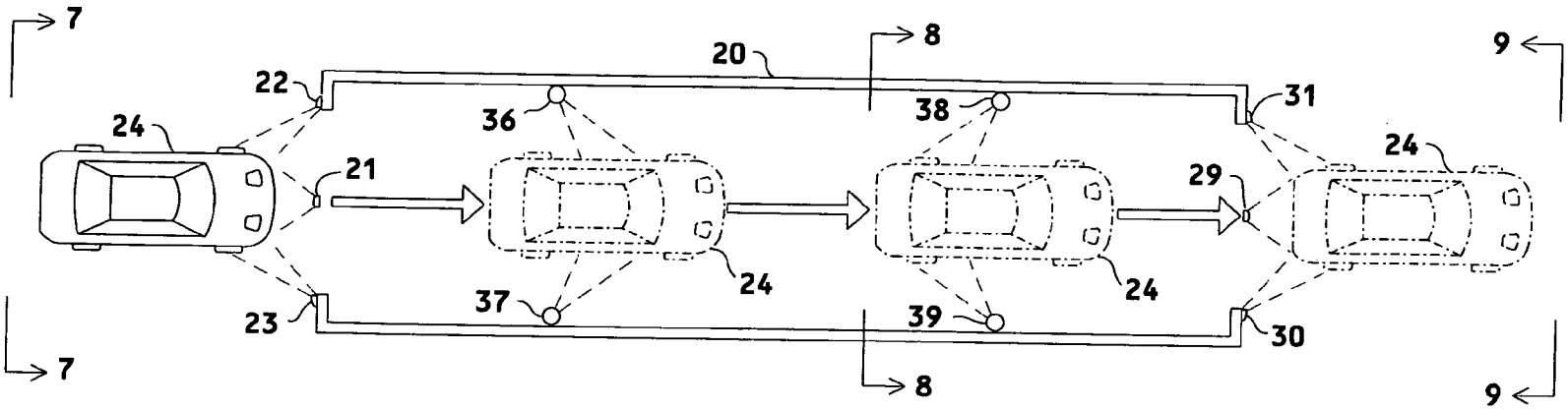
Figure 6:
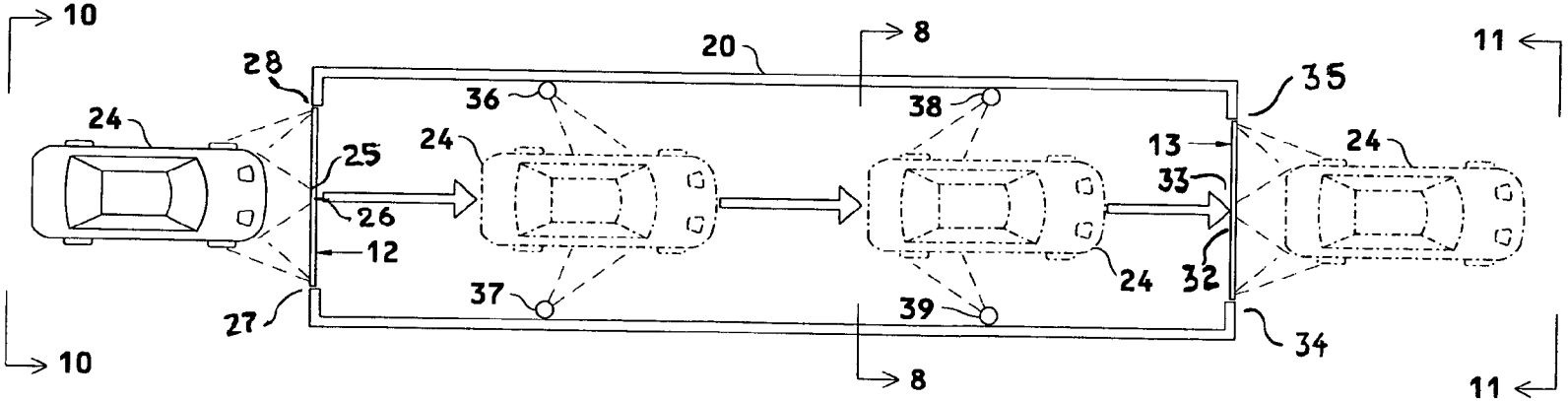
Figure 7:
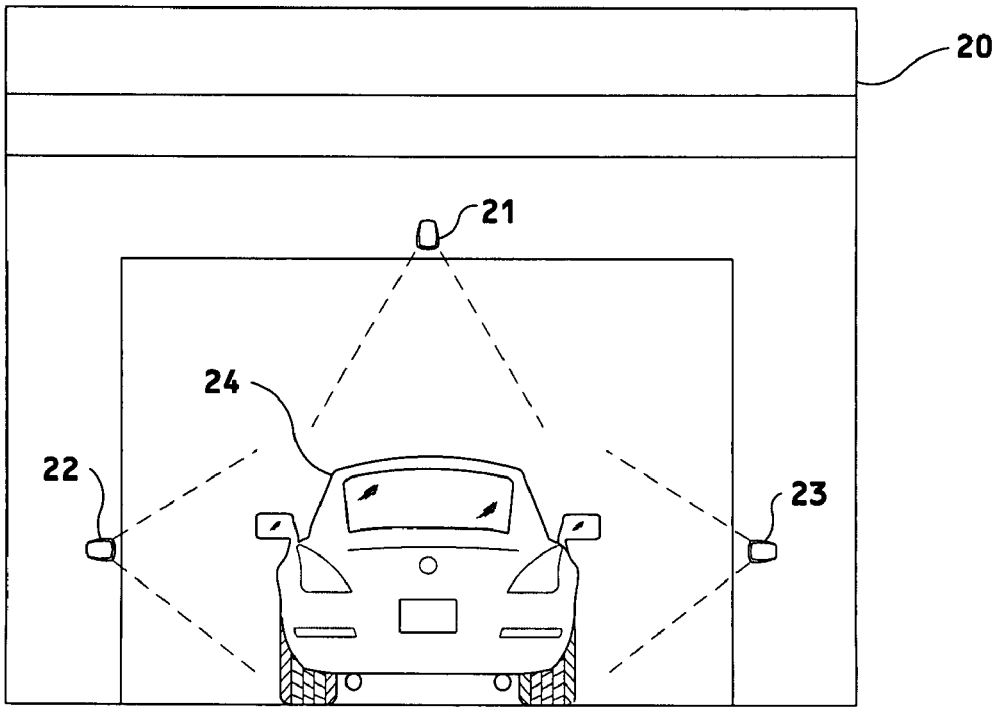
Figure 8:
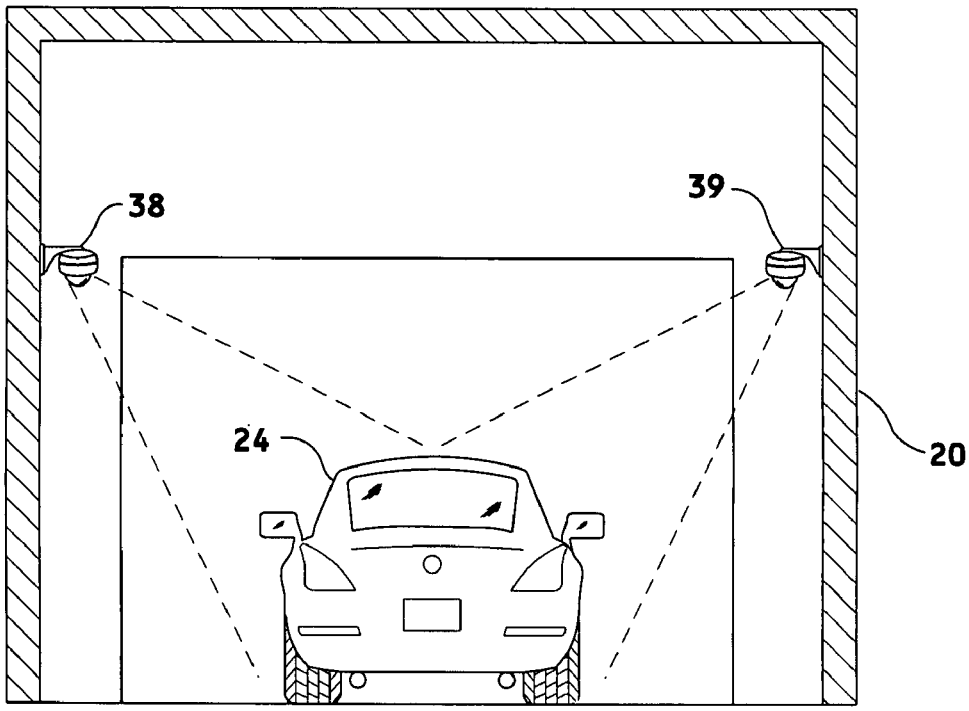
Figure 9:
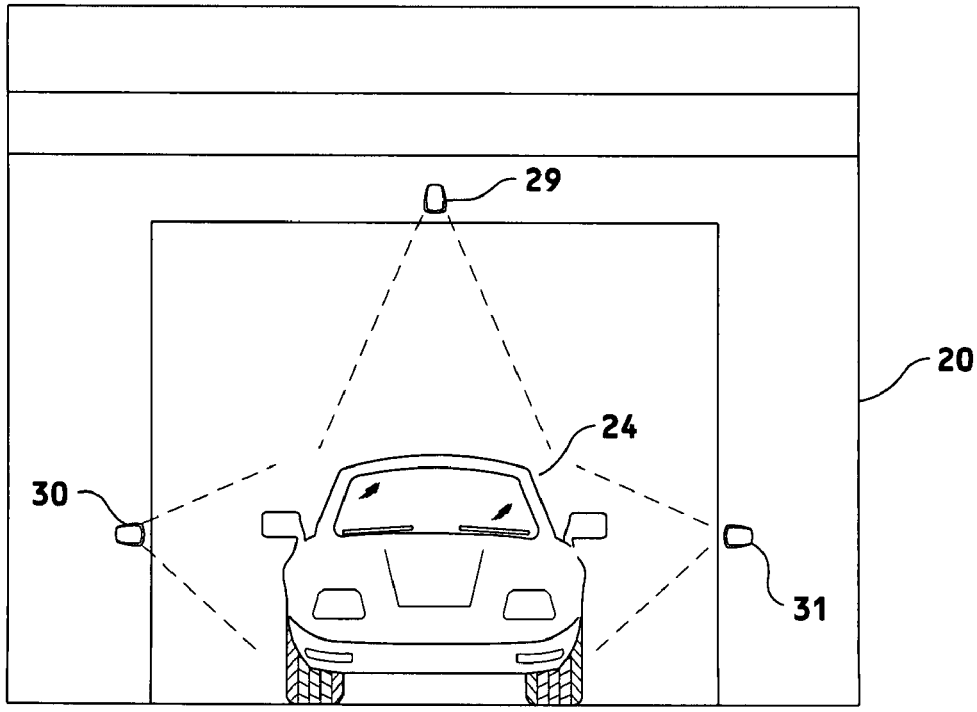
Figure 10:
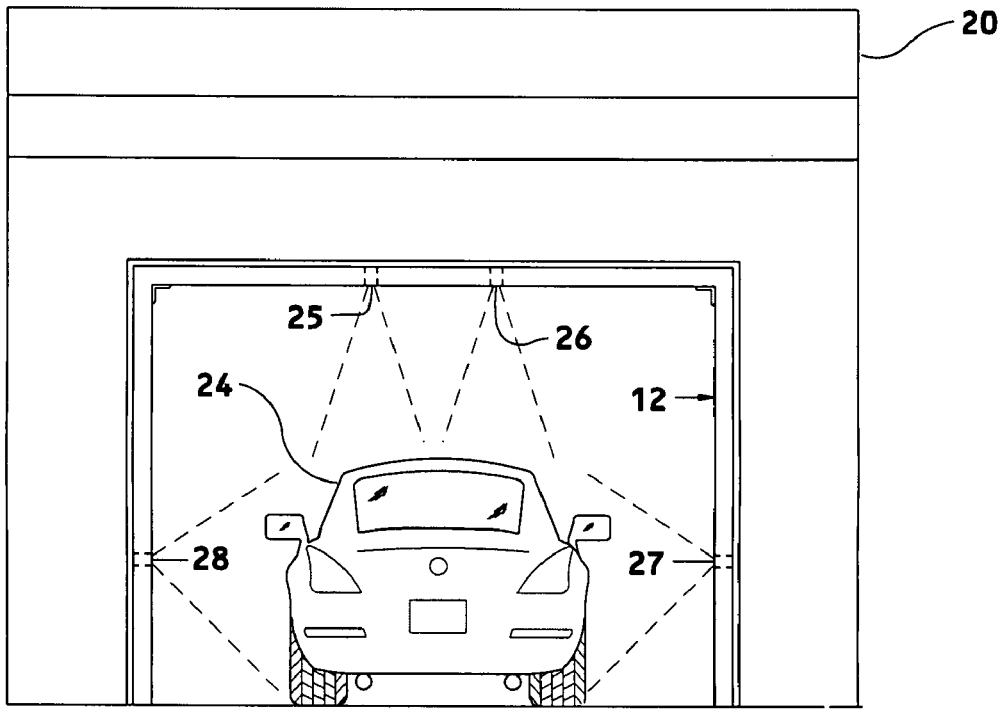
Figure 11:
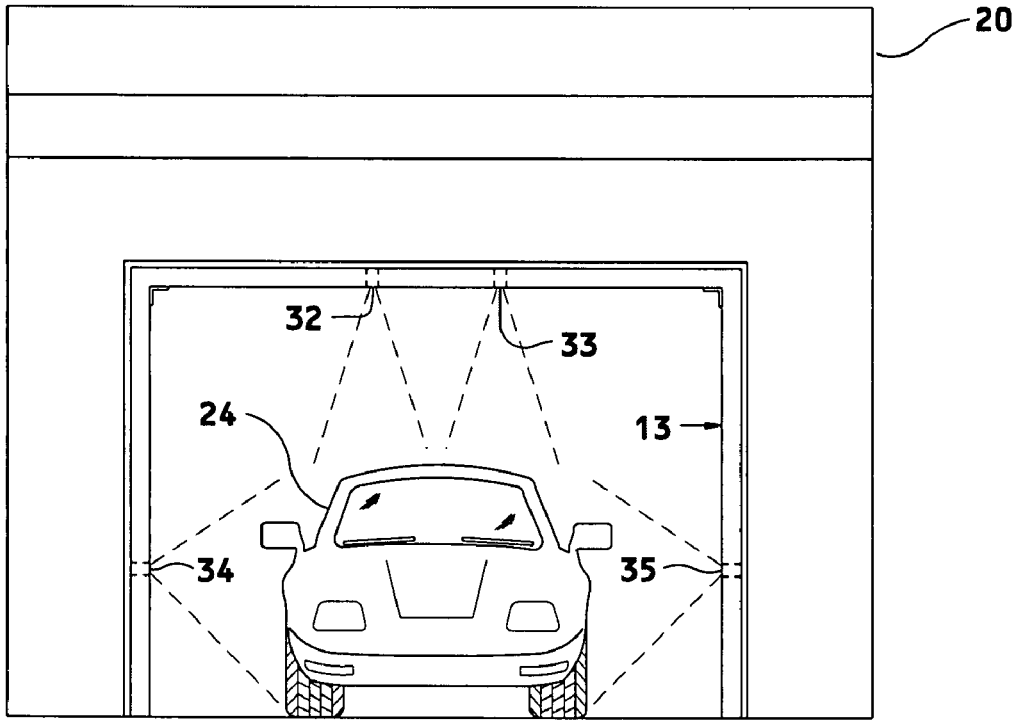
Figure 12:
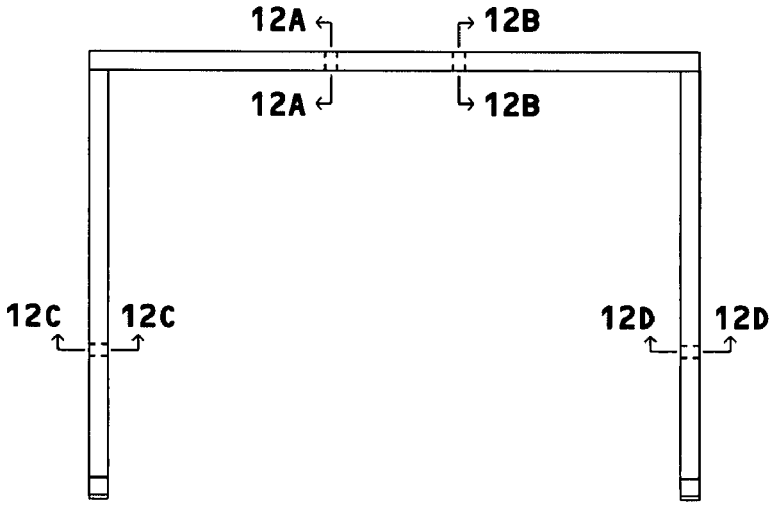
Figure 12A:
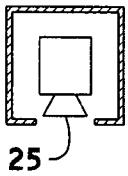
Figure 12B:
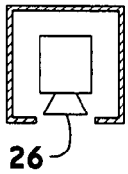
Figure 12C:
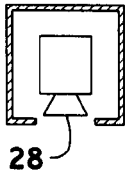
Figure 12D:
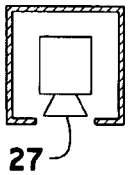
Figure 12E:
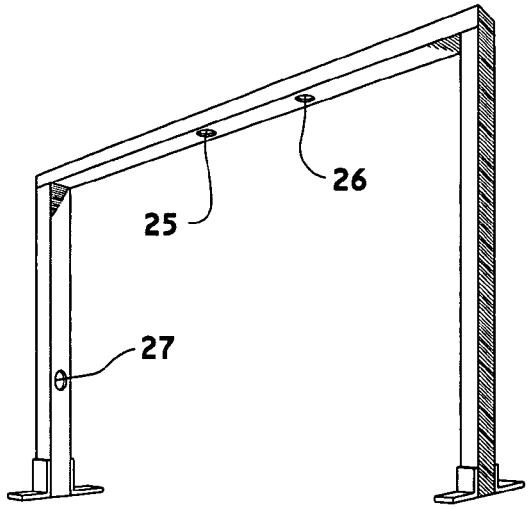
Figure 12F:
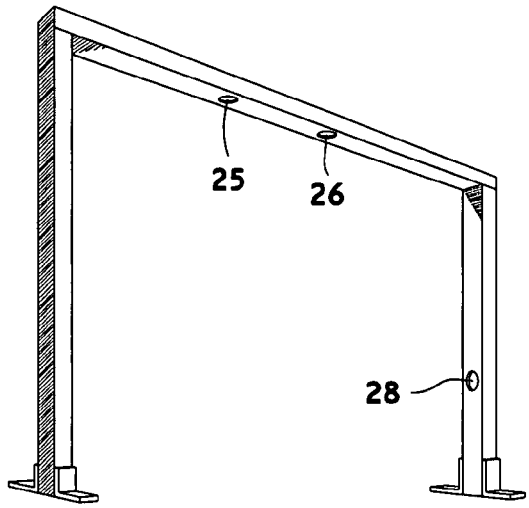
Figure 13:
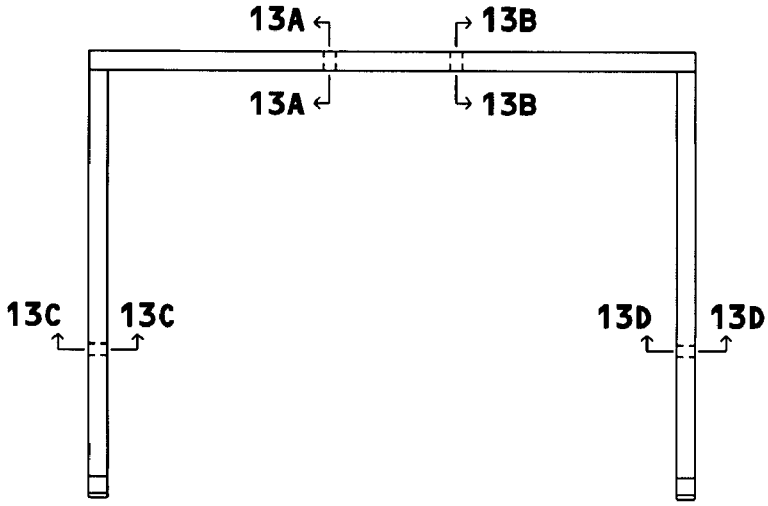
Figure 13A:
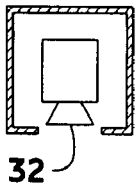
Figure 13B:
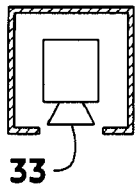
Figure 13C:
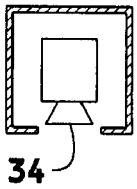
Figure 13D:
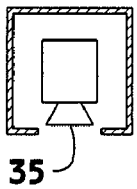
Figure 13E:
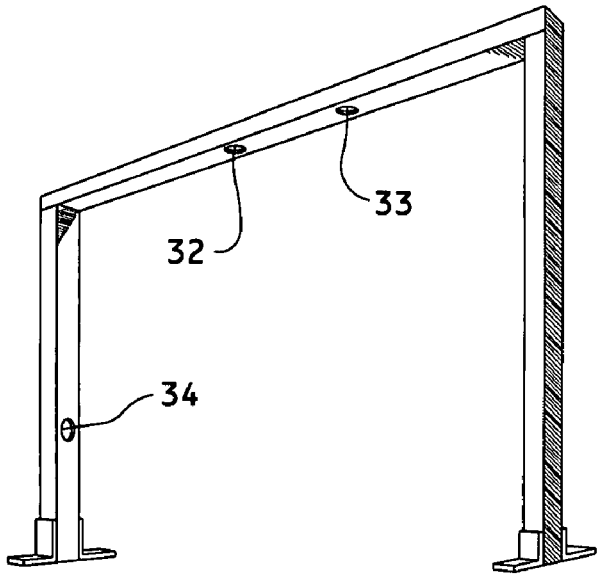
Figure 13F:
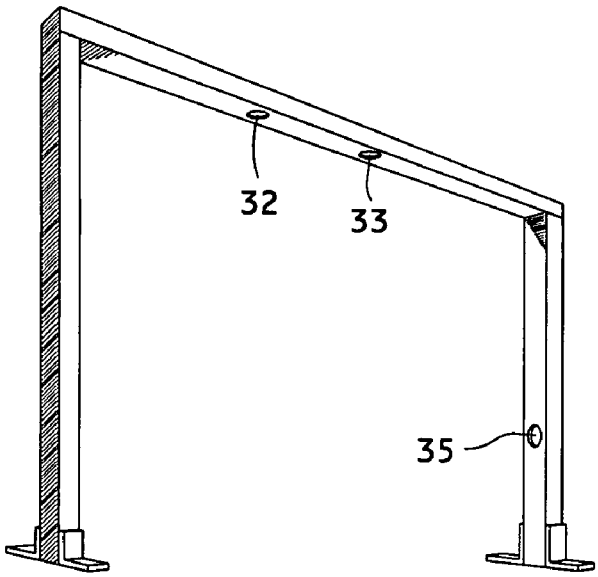

figure two (labeled "FIG. 2" in the drawings) is a drawing of an embodiment of a method and apparatus for documenting the condition of a vehicle, where camera devices 27 & 28 are facing opposing sides of a tunnel 20 recording side views of a vehicle 24, and camera devices 25 & 26 are facing down recording overhead views of the vehicle 24, as the vehicle 24 approaches and enters the tunnel 20;

figure three (labeled "FIG. 3" in the drawings) is a drawing of an embodiment of a method and apparatus for documenting the condition of a vehicle, where camera devices 30 & 31 are facing opposing sides of a tunnel 20 recording side views of a vehicle 24, and a camera device 29 is facing down recording overhead views of the vehicle 24, as the vehicle 24 exits and leaves the tunnel 20;

figure four (labeled "FIG. 4" in the drawings) is a drawing of an embodiment of a method and apparatus for documenting the condition of a vehicle, where camera devices 34 & 35 are facing opposing sides of a tunnel 20 recording side views of a vehicle 24, and camera devices 32 & 33 are facing down recording overhead views of the vehicle 24, as the vehicle 24 exits and leaves the tunnel 20;

figure five (labeled "FIG. 5" in the drawings) is a drawing of an embodiment of a method and apparatus for documenting the condition of a vehicle, where camera devices 22, 23, 30, 31, 36, 37, 38, & 39 are facing opposing sides of a tunnel 20 recording side views of a vehicle 24, a camera device 21 is facing down and/or facing out of the tunnel 20 recording overhead and/or front views of the vehicle 24, camera devices 36 & 37 are facing into the tunnel 20 recording rear views of the vehicle 24, camera devices 38 & 39 are facing into the tunnel 20 recording front views of the vehicle 24, and a camera device 29 is facing down and/or facing out of the tunnel 20 recording overhead and/or rear views of the vehicle 24, as the vehicle 24 enters and exits the tunnel 20;

figure six (labeled "FIG. 6" in the drawings) is a drawing of an embodiment of a method and apparatus for documenting the condition of a vehicle, where camera devices 27, 28, 34, 35, 36, 37, 38, & 39 are facing opposing sides of a tunnel 20 recording side views of a vehicle 24, camera devices 25 & 26 are facing down and/or facing out of the tunnel 20 recording overhead and/or front views of the vehicle 24, camera devices 36 & 37 are facing into the tunnel 20 recording rear views of the vehicle 24, camera devices 38 & 39 are facing into the tunnel 20 recording front views of the vehicle 24, and camera devices 32 & 33 are facing down and/or facing out of the tunnel 20 recording overhead and/or rear views of the vehicle 24, as the vehicle 24 enters and exits the tunnel 20;

figure seven (labeled "FIG. 7" in the drawings) is a drawing of an embodiment of a method and apparatus for documenting the condition of a vehicle, where camera devices 22 & 23 are facing opposing sides of a tunnel 20 recording side views of a vehicle 24 and a camera device 21 is facing down and/or facing out of the tunnel 20 recording overhead and/or front views of the vehicle 24 as the vehicle 24 approaches and enters the tunnel 20;

figure eight (labeled "FIG. 8" in the drawings) is a drawing of an embodiment of a method and apparatus for documenting the condition of a vehicle, where camera devices 38 & 39 are facing opposing sides of a tunnel 20 recording side views of a vehicle 24, camera devices 38 & 39 are facing down and/or facing out of the tunnel 20 recording overhead and/or front views of the vehicle 24, camera devices 38 & 39 are facing into the tunnel 20 recording rear views of the vehicle 24, camera devices 38 & 39 are facing into the tunnel 20 recording front views of the vehicle 24, and/or camera devices 38 & 39 are facing down and/or facing out of the tunnel 20 recording overhead and/or rear views of the vehicle 24, as the vehicle 24 enters and exits the tunnel 20;

figure nine (labeled "FIG. 9" in the drawings) is a drawing of an embodiment of a method and apparatus for documenting the condition of a vehicle, where camera devices 30 & 31 are facing opposing sides of a tunnel 20 recording side views of a vehicle 24, and a camera device 29 is facing down and/or facing out of the tunnel 20 recording overhead and/or rear views of the vehicle 24 as the vehicle 24 exits and leaves the tunnel 20;

figure ten (labeled "FIG. 10" in the drawings) is a drawing of an embodiment of a method and apparatus for documenting the condition of a vehicle, where camera devices 27 & 28 are facing opposing sides of a tunnel 20 recording side views of a vehicle 24, and camera devices 25 & 26 are facing down and/or facing out of the tunnel 20 recording overhead and/or front views of the vehicle 24, as the vehicle 24 approaches and enters the tunnel 20;

figure eleven (labeled "FIG. 11" in the drawings) is a drawing of an embodiment of a method and apparatus for documenting the condition of a vehicle, where camera devices 34 & 35 are facing opposing sides of a tunnel 20 recording side views of a vehicle 24, and camera devices 32 & 33 are facing down and/or facing out of the tunnel 20 recording overhead and/or rear views of the vehicle 24, as the vehicle 24 exits and leaves the tunnel 20;

figure twelve (labeled "FIG. 12" in the drawings) is a drawing of an embodiment of a frame for attaching camera devices;

figure twelve-a, twelve-b, twelve-c, and twelve-d (labeled "FIG. 12A", "FIG. 12B", "FIG. 12C", and "FIG. 12D" in the drawings) are drawings of embodiments of cameras 25, 26, 27, & 28 enclosed in housings that are attached to a frame;

figure twelve-e and twelve-f (labeled "FIG. 12E" and "FIG. 12F" in the drawings) are drawings of an embodiment of a frame with housed cameras 25, 26, 27, & 28.

figure thirteen (labeled "FIG. 13" in the drawings) is a drawing of an embodiment of a frame for attaching camera devices;

figure thirteen-a, thirteen-b, thirteen-c, and thirteen-d (labeled "FIG. 13A", "FIG. 13B", "FIG. 13C", and "FIG. 13D" in the drawings) are drawings of embodiments of cameras 32, 33, 34, & 35 enclosed in housings that are attached to a frame; and figure thirteen-e and thirteen-f (labeled "FIG. 13E" and "FIG. 13F" in the drawings) are drawings of an embodiment of a frame with housed cameras 32, 33, 34, & 35.

DETAILED DESCRIPTION

Embodiments of a Method for Recording the Condition of a Vehicle

Figures one through eleven depict different embodiments of a method for documenting the condition of a vehicle 24 before it enters a tunnel 20, while it enters the tunnel 20, while it exits the tunnel 20, and after it leaves the tunnel 20. Figures five, six, and eight also depict different embodiments of a method for documenting the condition of a vehicle 24 while it is inside the tunnel 20.

In figures one, two, five, six, seven, and ten, camera devices 21, 22, 23, 25, 26, 27, & 28 are mounted to face out of the tunnel 20 for recording front views of the vehicle 24 before it enters the tunnel 20 and while it enters the tunnel 20. Camera devices 25, 26, 27, & 28 are attached to a frame 12 installed at the entrance of the tunnel 20, inside the tunnel 20, or outside the tunnel 20. In a preferred embodiment, the frame 12 is positioned as close to the entrance as possible or in the entrance. In addition, camera devices can be directly attached to a structure of the tunnel 20 (see camera devices 21, 22, & 23). The exact position and direction that the camera devices face can vary; however, in a preferred embodiment, camera devices 21, 22, 23, 25, 26, 27, & 28 are positioned and directed in a manner that provides maximum visibility of the front of the vehicle 24.

In figures one, two, five, six, seven, and ten, camera devices 21, 25, & 26 are mounted to face down for recording overhead views of the vehicle 24 before it enters the tunnel 20 and while it enters the tunnel 20. Camera devices 25 & 26 are attached to a frame 12 installed at the entrance of the tunnel 20, inside the tunnel 20, or outside the tunnel 20. In a preferred embodiment, the frame 12 is positioned as close to the entrance as possible or in the entrance. In addition, camera devices can be directly attached to a structure of the tunnel 20 (see camera device 21). The exact position and direction that the camera devices face can vary; however, in a preferred embodiment, camera devices 21, 25 & 26 are positioned and directed in a manner that provides maximum visibility of the top surfaces of the vehicle 24, including overhead views of hood, roof, and trunk.

In figures five and six, camera devices 36 & 37 are mounted to face into the tunnel 20 for recording rear views of the vehicle 24 while it enters the tunnel 20 and just after it enters the tunnel 20. Camera devices 36 & 37 are attached to a frame 12 or attached directly to the structure of the tunnel 20. The camera devices can be installed at the entrance of the tunnel 20, inside the tunnel 20, or outside the tunnel 20. In a preferred embodiment, the camera devices are positioned as close to the entrance as possible or in the entrance. The exact position and direction that the camera devices face can vary; however, in a preferred embodiment, camera devices 36 & 37 are positioned and directed in a manner that provides maximum visibility of the rear view of the vehicle 24, including views of the tires, bumper, trunk, and rear window.

In figures one, two, five, six, seven, and ten, camera devices 22, 23, 27, 28, 36, & 37 are mounted to face opposing sides of the tunnel 20 for recording side views of the vehicle 24 before it enters the tunnel 20, while it is enters the tunnel 20, and just after it enters the tunnel 20. Camera devices 27 & 28 are attached to a frame 12 installed at the entrance of the tunnel 20, inside the tunnel 20, or outside the tunnel 20. In addition, camera devices can be directly attached to the structure of the tunnel 20 (see camera devices 22 & 23). Camera devices 36 & 37 are attached to a frame 12 or attached directly to the structure of the tunnel 20. In a preferred embodiment, the camera devices are positioned as close to the entrance as possible or in the entrance. The exact position and direction that the camera devices face can vary; however, in a preferred embodiment, camera devices 22, 23, 27, 28, 36, & 37 are positioned and directed in a manner that provides maximum visibility of the side views of the vehicle 24, including views of the wheels, bumper, body, trim, and side windows.

In figures three, four, five, six, eight, nine, and eleven, camera devices 29, 30, 31, 32, 33, 34, 35, 38, & 39 are mounted to face out of the tunnel 20 for recording rear views of the vehicle 24 just before it exits the tunnel 20, while it exits the tunnel 20, and after it exits the tunnel 20. Camera devices 32, 33, 34 & 35 are attached to a frame 13 installed at the exit of the tunnel 20, inside the tunnel 20, or outside the tunnel 20. In a preferred embodiment, the frame 13 is positioned as close to the exit as possible or in the exit. In addition, camera devices can be directly attached to the structure of the tunnel 20 (see camera devices 29, 30 & 31). Camera devices 38 & 39 are attached to a frame 13 or attached directly to the structure of the tunnel 20. The exact position and direction that the camera devices face can vary; however, in a preferred embodiment, camera devices 29, 30, 31, 32, 33, 34, 35, 38, & 39 are positioned and directed in a manner that provides maximum visibility of the rear of the vehicle 24.

In figures three, four, five, six, eight, nine, and eleven, camera devices 29, 32, 33, 38, & 39 are mounted to face downward for recording overhead views of the vehicle 24 before it exits the tunnel 20, while it exits the tunnel 20, and after it exits the tunnel 20. Camera devices 32 & 33 are attached to a frame 13 installed at the exit of the tunnel 20, inside the tunnel 20, or outside the tunnel 20. In a preferred embodiment, the frame 13 is positioned as close to the exit as possible or in the exit. In addition, camera devices can be directly attached to the structure of the tunnel 20 (see camera device 29). Camera devices 38 & 39 are attached to a frame 13 or attached directly to the structure of the tunnel 20. The exact position and direction that the camera devices face can vary; however, in a preferred embodiment, camera devices 29, 32, 33, 38, & 39 are positioned and directed in a manner that provides maximum visibility of the top surfaces of the vehicle 24, including overhead views of hood, roof, and trunk 24.

In figures three and eight, camera devices 38 & 39 face into the tunnel 20 for recording front views of the vehicle 24 before it exits the tunnel 20, while it exits the tunnel 20, and after it exits the tunnel 20. Camera devices 38 & 39 are attached to a frame 13 or attached directly to the structure of the tunnel 20. The camera devices can be installed at the exit of the tunnel 20, inside the tunnel 20, or outside the tunnel 20. In a preferred embodiment, the camera devices are positioned as close to the exit as possible or in the exit. The exact position and direction that the camera devices face can vary; however, in a preferred embodiment, camera devices 38 & 39 are positioned and directed in a manner that provides maximum visibility of the front views of the vehicle 24, including views of the tires, head lights, bumper, grill, and front windshield.

In figures three, four, five, six, nine, and eleven, camera devices 30, 31, 34, 35, 38, & 39 are mounted to face opposing sides of the tunnel 20 for recording side views of the vehicle 24 before it exits the tunnel 20, while it exits the tunnel 20, and after it exits the tunnel 20. Camera devices 34 & 35 are attached to a frame 13 installed at the exit of the tunnel 20, inside the tunnel 20, or outside the tunnel 20. In addition, camera devices can be directly attached to the structure of the tunnel 20 (see camera devices 30 & 31). Camera devices 38 & 39 are attached to a frame 13 or attached directly to the structure of the tunnel 20. In a preferred embodiment, the camera devices 30, 31, 34, 35, 38, & 39 are positioned as close to the exit as possible or in the exit. The exact position and direction that the camera devices face can vary; however, in a preferred embodiment, camera devices 30, 31, 34, 35, 38, & 39 are positioned and directed in a manner that provides maximum visibility of the side views of the vehicle 24, including views of the wheels, bumper, lights, body, trim, and side windows.

Camera devices can be positioned and directed in any manner that gives maximum visibility to varying views of a vehicle entering and exiting a tunnel. In a preferred embodiment, the camera devices are fixed. However, no wording in this specification should be read to limit camera devices to the type that have a fixed view or are stationary. Cameras can move to get varying angles of the vehicle 24. This would be useful in situations that a vehicle is stationary, as is common in a full service tunnel.

In a preferred embodiment, a greater number of camera devices can be advantageous if the devices are placed in varying positions and directions to provide as many views of a vehicle has possible. However, a camera device with a wide view can be just has effective at capturing many views of the vehicle and can reduce the number of camera devices employed by a tunnel.

In a preferred embodiment, the camera device comprises a digital video camera. However, a digital video camera can be replaced with a still camera or non-digital video camera. In addition, a higher resolution video camera is preferred.

In a preferred embodiment, camera devices that are susceptible to vandalism or weather damage, such as camera devices that are at a lower position or are on the exterior of the tunnel, are encased in vandalism and weather resistant housing.

In a preferred embodiment, all camera devices are waterproof. Waterproof camera devices or housings are especially useful when a tunnel is a car wash tunnel. The extent of the water resistance of a camera device or housing varies depending on the specific needs of a tunnel operator.

In a preferred embodiment, the footage taken by a camera device is communicated to a storage device. When a digital camera is employed it is preferred that the storage device be a digital video recorder (DVR).

Embodiments of an Apparatus for Documenting the Condition of a Vehicle

Figures twelve through twelve-f and thirteen through thirteen-f depict an embodiment of an apparatus for documenting the condition of a vehicle as it enters a tunnel, when it is inside the tunnel, and as it exits the tunnel. The apparatus comprises a frame and camera devices that attach to the frame. A camera device can comprise a camera encompassed by a housing (see figures twelve-a, twelve-b, twelve-c, twelve-d, twelve-e, twelve-f, thirteen-a, thirteen-b, thirteen-c, thirteen-d, thirteen-e, and thirteen-f).

Figure twelve and thirteen are drawings of embodiments of a frame for attaching camera devices employed by a tunnel. The frame in figures twelve and thirteen show four areas (12A, 12B, 12C, & 12D in the case of figure twelve and 13A, 13B, 13C, & 13D in the case of figure thirteen) for attaching or installing a camera device.

Figure twelve-a, twelve-b, twelve-c, and twelve-d depict housings for camera devices that are attached respectively to the frame in figure twelve at areas 12A, 12B, 12C and 12D. In figure twelve-a and twelve-b, camera devices 25 & 26 (see also figures twelve-e and twelve-f) are in housings that allow the devices to be in a position to face down, out of a tunnel, or into the tunnel recording overhead views, front views, or rear views of a vehicle entering the tunnel. In figure twelve-c and twelve-d, camera devices 27 & 28 (see also figures twelve-e and twelve-f) are in housings that allow the devices to be in a position to face opposing sides a tunnel, out of the tunnel, or into the tunnel for recording side views, front views, or rear views of a vehicle entering the tunnel.

Figure thirteen-a, thirteen-b, thirteen-c, and thirteen-d depict housings for camera devices that are attached respectively to the frame in figure thirteen at areas 13A, 13B, 13C & 13D. In figure thirteen-a and thirteen-b, cameras 32 & 33 (see also figures thirteen-e and thirteen-f) are in housings that allow the devices to be in a position to face down, out of a tunnel, or into the tunnel for recording top views, front views, or rear views of a vehicle exiting the tunnel. In figure thirteen-c and thirteen-d, camera 34 & 35 (see also figures thirteen-e and thirteen-f) are in housings that allow the cameras devices to be in a position to face opposing sides of the tunnel, out of the tunnel, or into the tunnel for recording side views, front views, or rear views of the vehicle exiting the tunnel.

A frame for housing camera devices can exist in the structure of a tunnel, as in figure one. In figure one, a tunnel structure 20 is in essence a frame that allows camera devices to be placed in positions that allow the camera devices to have front, rear, side, and top views of a vehicle 24 passing through the tunnel 20. A frame can also be inserted into a tunnel or attached to the entrance (see figure two, frame 12) or exit (see figure four, frame 13) of the tunnel.

In figure twelve and thirteen, each frame comprises two vertical beams and a horizontal beam that attaches the two vertical beams. The horizontal beam is attached to the vertical beams at the top of the vertical beams. The frames drawn in figures twelve and thirteen are merely preferred embodiments of a frame. A frame that houses camera devices or allows camera devices to attach to it can be many shapes, as long as the frame provides positioning that allows the camera devices to get preferred views of a vehicle entering and exiting a tunnel. Another preferred shape of a frame is an arch. The frame also can consist of one vertical beam or one horizontal beam attached to the ceiling or floor of a tunnel. On a side note, in a preferred embodiment, the frame is made out of aluminum.

Camera devices attached or embedded in a frame are usually positioned and directed in a manner that gives maximum visibility to a variety of views of a vehicle entering and exiting a tunnel. In a preferred embodiment, the camera devices are fixed to the frame. However, no wording in this specification should be read to limit cameras to being fixed to a frame. In other embodiments, camera devices that are attached to a frame can pivot or slide manually or mechanically if preferred by a customer. If the camera devices are not fixed their motion can be automated or manual. As mentioned prior, in a full service tunnel or in any other type of tunnel where a vehicle is stationary a camera that is free to move is preferred.

Though four positions (12A, 12B, 12C, & 12D in the case of figure twelve and 13A, 13B, 13C, & 13D in the case of figure thirteen) are available for attaching camera devices to the frames in figure twelve and figure thirteen, it is preferred to have a greater number of camera devices placed in varying positions around the frames. However, a camera devise with a wide view can be just as effective as a multitude of camera devices with narrow views at recording views of a vehicle entering, exiting, or passing through a tunnel.

In a preferred embodiment, a camera device comprises a video camera opposed to a still camera. In addition, a digital video camera is more preferred than other types of video cameras. A higher resolution camera is also preferred.

In a preferred embodiment, a camera device comprises a camera encased in a vandalism and weather resistant housing. It is preferred that the camera devices are small, so that they are not readily noticed. It is also preferred that the devices are stainless steel to limit rusting and general wear.

In addition, it is preferred that the camera devices are pre-assembled, pre-focused, and ready to be mounted to a frame or pre-installed in a frame. On a side note, the housings can be an individual structure or a structure of the frame.

It is also preferred that the housings are sealed, gasketed, weatherproof, and resistant to high-pressure washes (NEMA IP-66 rated). It is preferred that the housing comprise a ¼ inch thick lexan viewing window. In a preferred embodiment, the housing has enough internal space to allow a camera to move freely or be adjustable.

In a preferred embodiment, all camera devices attached to a frame are waterproof camera devices. The camera component can be waterproof and/or the housing can be waterproof. Waterproof camera devices become especially useful when a tunnel is specifically a car wash tunnel. The extent of a camera device's water resistance can vary. In the case of car wash tunnels, camera devices that are within a tunnel, are preferred to be resistant to mist, overspray and high humidity. This includes a resistance to condensation.

In a preferred embodiment, the camera devices are also resistant to chemicals used in a car wash, or used by tunnel operators for cleaning and maintenance.

As mentioned prior, it is preferred that the camera devices communicate footage to a storage device. In the case of digital video cameras being used it is preferred that the storage device used is a digital video recorder (DVR).

The invention claimed is:

1. A method for recording the condition of a vehicle as the vehicle approaches and enters a vehicle washing facility and after the vehicle exits and leaves the vehicle washing facility comprising, in combination: camera devices facing out of the vehicle washing facility recording front views of the vehicle as the vehicle approaches and enters the vehicle washing facility, wherein the camera devices facing out of the vehicle washing facility recording front views of the vehicle are positioned and operated in a manner that provide maximum visibility of the front views of the vehicle as the vehicle approaches and enters the vehicle washing facility; camera devices facing down recording overhead views of the vehicle as the vehicle approaches and enters the vehicle washing facility, wherein the camera devices facing down recording overhead views of the vehicle are positioned and operated in a manner that provide maximum visibility of the overhead views of the vehicle as the vehicle approaches and enters the vehicle washing facility; camera devices facing into the vehicle washing facility recording rear views of the vehicle as the vehicle enters the vehicle washing facility, wherein the camera devices facing into the vehicle washing facility recording rear views of the vehicle are positioned and operated in a manner that provide maximum visibility of the rear views of the vehicle as the vehicle approaches and enters the vehicle washing facility; camera devices facing opposing sides of the vehicle washing facility recording side views of the vehicle as the vehicle approaches and enters the vehicle washing facility, wherein the camera devices facing opposing sides of the vehicle washing facility recording side views of the vehicle are positioned and operated in a manner that provide maximum visibility of the side views of the vehicle as the vehicle approaches and enters the vehicle washing facility; camera devices facing out of the vehicle washing facility recording rear views of the vehicle as the vehicle exits and leaves the vehicle washing facility, wherein the camera devices facing out of the vehicle washing facility recording rear views of the vehicle as the vehicle exits and leaves the vehicle washing facility are positioned and operated in a manner that provide maximum visibility of the rear views of the vehicle as the vehicle exits and leaves the vehicle washing facility; camera devices facing down recording overhead views of the vehicle as the vehicle exits and leaves the vehicle washing facility, wherein the camera devices facing down recording overhead views of the vehicle as the vehicle exits and leaves the vehicle washing facility are positioned and operated in a manner that provide maximum visibility of the overhead views of the vehicle as the vehicle exits and leaves the vehicle washing facility; camera devices facing into the vehicle washing facility recording front views of the vehicle as the vehicle exits the vehicle washing facility, wherein the camera devices facing into of the vehicle washing facility recording front views of the vehicle as the vehicle exits and leaves the vehicle washing facility are positioned and operated in a manner that provide maximum visibility of the front views of the vehicle as the vehicle exits and leaves the vehicle washing facility; and camera devices facing opposing sides of the vehicle washing facility recording side views of the vehicle as the vehicle exits and leaves the vehicle washing facility, wherein the camera devices facing opposing sides of the vehicle washing facility recording side views of the vehicle as the vehicle exits and leaves the vehicle washing facility are positioned and operated in a manner that provide maximum visibility of the side views of the vehicle as the vehicle exits and leaves the vehicle washing facility; and comparing the recorded views to identify damage to the vehicle incurred in the vehicle washing facility.

2. The method of claim 1, wherein at least one of the camera devices attaches to a frame.

3. The method of claim 1, wherein at least one of the camera devices attaches to a structure of the vehicle washing facility.

4. The method of claim 1, wherein at least one of the camera devices is weather resistant, vandalism resistant, resistant to cleaning agents, waterproof, and condensation resistant.

5. The method of claim 1, wherein: the overhead views of the vehicle comprise overhead views of the hood, roof, and trunk of the vehicle; the rear views of the vehicle comprise rear views of the tires, bumper, trunk, and rear window of the vehicle; the side views of the vehicle comprise side views of the wheels, bumper, body, trim, and side windows of the vehicle; the front views of the vehicle comprise front views of the tires, head lights, bumper, grill, and windshield.

6. The method of claim 1, wherein: at least one of the camera devices is close enough to an opening of the vehicle washing facility to allow for well-lit views of the vehicle without the use of artificial lighting.

7. The method of claim 1, wherein: the camera devices facing out of the vehicle washing facility, the camera devices facing down, and the camera devices facing opposing sides of the vehicle washing facility recording views of the vehicle as the vehicle approaches and enters the vehicle washing facility attach to an outer surface of a front wall of the vehicle washing facility and are weather and vandalism resistant; and the camera devices facing out of the vehicle washing facility, the camera devices facing down, and the camera devices facing opposing sides of the vehicle washing facility recording views of the vehicle as the vehicle exits and leaves the vehicle washing facility attach to an outer surface of a back wall of the vehicle washing facility and are weather and vandalism resistant.

8. The method of claim 1 wherein: the camera devices facing out of the vehicle washing facility, the camera devices facing down, and the camera devices facing opposing sides of the vehicle washing facility recording views of the vehicle as the vehicle enters the vehicle washing facility attach to a frame in an entrance of the vehicle washing facility and are weather and vandalism resistant; and the camera devices facing out of the vehicle washing facility, the camera devices facing down, and the camera devices facing opposing sides of the vehicle washing facility recording views of the vehicle as the vehicle exits and leaves the vehicle washing facility attach to a frame in an exit of the vehicle washing facility and are weather and vandalism resistant.

9. The method of claim 1, wherein the vehicle washing facility is a tunnel car wash.

10. The method of claim 1, wherein the camera devices communicate footage of the vehicle to a media storage device.

11. The method of claim 10. wherein the media storage device is a digital media storage device.

12. The method of claim 1, wherein a housing structure encloses at least one of the camera devices.

13. The method of claim 12, wherein the housing structure is sealed, is gasketed, is weatherproof, is resistant to high-pressure washes, and has enough internal space to allow a camera to be adjustable.

14. The method of claim 1, wherein at least one of the camera devises is a video camera.

15. The method of claim 14, wherein the video camera is a digital video camera.

* * * * *